US005337665A

United States Patent [19]

Fassman et al.

[11] Patent Number: 5,337,665

[45] Date of Patent: Aug. 16, 1994

[54] MAILING MACHINE INCLUDING POSTAGE METER HAVING ROTARY POSTAGE PRINTING DRUM PROVIDED WITH AN ENVELOPE DEFLECTOR

[75] Inventors: Arnold Fassman, Westport; Stephen J. Rigo; Alfred Spath, both of Stamford, all of Conn.

[73] Assignee: Pitney Bowes Inc., Stamford, Conn.

[21] Appl. No.: 85,366

[22] Filed: Jul. 2, 1993

[51] Int. Cl.[5] ..... B41F 13/24

[52] U.S. Cl. ..... 101/235; 101/91

[58] Field of Search ..... 101/232, 233, 234, 235, 101/91, 37; 400/56, 643, 645; 271/274, 275

[56] References Cited

U.S. PATENT DOCUMENTS

| | | | |
|---|---|---|---|
| 2,934,009 | 4/1990 | Bach et al. | 101/235 |
| 3,072,052 | 1/1993 | Bach | 101/235 |
| 4,763,575 | 8/1988 | Miciukiewicz | 101/91 |
| 5,046,419 | 9/1991 | Zoltner | 101/235 |
| 5,251,554 | 10/1993 | Eckert, Jr. et al. | 101/91 |

*Primary Examiner*—Ren Yan

*Attorney, Agent, or Firm*—Melvin J. Scolnick; Donald P. Walker; Robert E. Meyer

[57] ABSTRACT

A mailing machine, comprising a base including a deck, a postage meter removably mounted on the base, the postage meter including a rotary postage printing drum overhanging the deck, the base including means for feeding an envelope in a downstream path of travel to the drum, the base including means for selectively driving the drum for printing postage on an envelope fed thereto, envelope deflecting means including an elongate substantially rectangularly-shaped member having a predetermined length, the member including a substantially horizontally-extending first portion of the length thereof fixedly attached to the drum, the member including a second portion of the length thereof inclined downwardly from the first portion, the member including a third portion of the length thereof inclined upwardly from the second portion, the member including a fourth portion of the length thereof extending substantially horizontally from the third portion and disposed between and in sliding engagement with the drum and the first portion, and the second and third portions cooperatively defining a lower marginal peak edge overhanging the deck and extending transversely of the path of travel for urging an envelope fed beneath the drum into sliding engagement with the deck.

7 Claims, 3 Drawing Sheets

MAILING MACHINE INCLUDING POSTAGE METER HAVING ROTARY POSTAGE PRINTING DRUM PROVIDED WITH AN ENVELOPE DEFLECTOR

BACKGROUND OF THE INVENTION

This invention is generally concerned with a mailing machine including a postage meter having a rotary postage printing drum provided with an envelope deflector, and more particularly, with an improved deflector.

U.S. Pat. No. 3,072,052 for Automatic Feeding Apparatus, issued Jan. 8, 1963 to Bach, and assigned to the assignee of the present invention, discloses a mailing machine including a base, having an inking roller, and including a postage meter, having a rotary postage printing drum which is removably mounted on the base. The mailing machine additionally includes structure for feeding envelopes therethrough in a downstream path of travel to the postage meter. And, downstream from the postage printing drum, the mailing machine includes outfeed roller structure, including a spring loaded roller in the meter, for urging envelopes downwardly, and a driven feed roller in the base for feeding envelopes beneath the spring loaded roller out of the machine.

U.S. Patent application Ser. No. 07/810,597 for a Mailing Machine Including Printing Drum Decleration And Coasting Control System, by Eckert, Jr., et. al., and assigned to the assignee of the present invention, discloses a mailing machine of the aforesaid type which includes a control system in the base for operating the mailing machine in various modes of operation, including, inter alia, "print and seal" and "seal only" modes of operation. In the "print and seal" mode, the postage printing drum is driven through a single revolution and into engagement with the envelope to both feed and print a postage value on the envelope, as it is fed downstream to the outfeed roller structure. And, in the "seal only" mode, the postage printing drum is not driven, but rather the envelope is fed downstream beneath the drum and thus directly to the outfeed roller structure. Since the postage printing drum is not driven into engagement with envelopes in the "seal only" mode of operation, such envelopes may not remain in contact with the deck as they are fed beneath the drum to the outfeed roller structure. Rather, such envelopes may become jammed against the outfeed roller structure. Accordingly, the postage printing drums of mailing machines have been equipped with envelope deflecting structures, including a spring loaded device which is fixedly attached to the postage printing drum so a to depend therefrom and into the path of travel of envelopes beneath the drum, to apply a normal, or hold down, force to the envelopes to ensure that they are properly fed to the outfeed roller structure.

The aforesaid envelope deflecting structure has historically been fabricated from a multiplicity of stainless steel sheet metal stampings provided with adjustable portions configured for sliding engagement with one another, and a stainless steel spring and hinge pin. Aside from the high cost of manufacture, such deflectors are noisy in operation and require the attention of highly skilled field maintenance personnel to adjust the operation thereof from time-to-time. Accordingly, an object of the invention is to provide an improved mailing machine including a postage printing drum provided with a low cost, operationally quiet, envelope deflecting device;

another object is to provide envelope deflecting structure for use in a postage meter including a rotary postage printing drum; and another object is to provide envelope deflecting structure for use in a postage meter, wherein such structure is a single piece part molded from a resilient thermoplastic plastic material.

SUMMARY OF THE INVENTION

A mailing machine comprising a base including a deck, a postage meter removably mounted on the base, the postage meter including a rotary postage printing drum Overhanging the deck, the base including means for feeding an envelope in a downstream path of travel to the drum, the base including means for selectively driving the drum for printing postage on an envelope fed thereto, envelope deflecting means including an elongate substantially rectangularly-shaped member having a predetermined length, the member including a substantially horizontally-extending first portion of the length thereof fixedly attached to the drum, the member including a second portion of the length thereof inclined downwardly from the first portion, the member including a third portion of the length thereof inclined upwardly from the second portion, the member including a fourth portion of the length thereof extending substantially horizontally from the third portion and disposed between and in sliding engagement with the drum and the first portion, and the second and third portions cooperatively defining a lower marginal peak edge overhanging the deck and extending transversely of the path of travel for urging an envelope fed beneath the drum into sliding engagement with the deck.

A mailing machine comprising, a base including a deck, a postage meter removably mounted on the base, the postage meter including a rotary postage printing drum overhanging the deck, the base including means for feeding an envelope in a downstream path of travel to the drum, the base including means for selectively driving the drum for printing postage on an envelope fed thereto, envelope deflecting means including an elongate substantially rectangularly-shaped member having a predetermined length, the member including a substantially horizontally-extending first portion of the length thereof fixedly attached to the drum, the member including a second portion of the length thereof inclined downwardly from the first portion, the member including a third portion of the length thereof inclined upwardly from the second portion, the member including a fourth portion of the length thereof extending substantially horizontally from the third portion and disposed between and in sliding engagement with the drum and the first portion, and the second and third portions cooperatively defining a lower marginal peak edge overhanging the deck and extending transversely of the path of travel for urging an envelope fed beneath the drum into sliding engagement with the deck.

BRIEF DESCRIPTION OF THE DRAWINGS

As shown in the drawings wherein like reference numerals designate like or corresponding parts throughout the several views.

DESCRIPTION OF THE PREFERRED EMBODIMENTS

Figure 1:
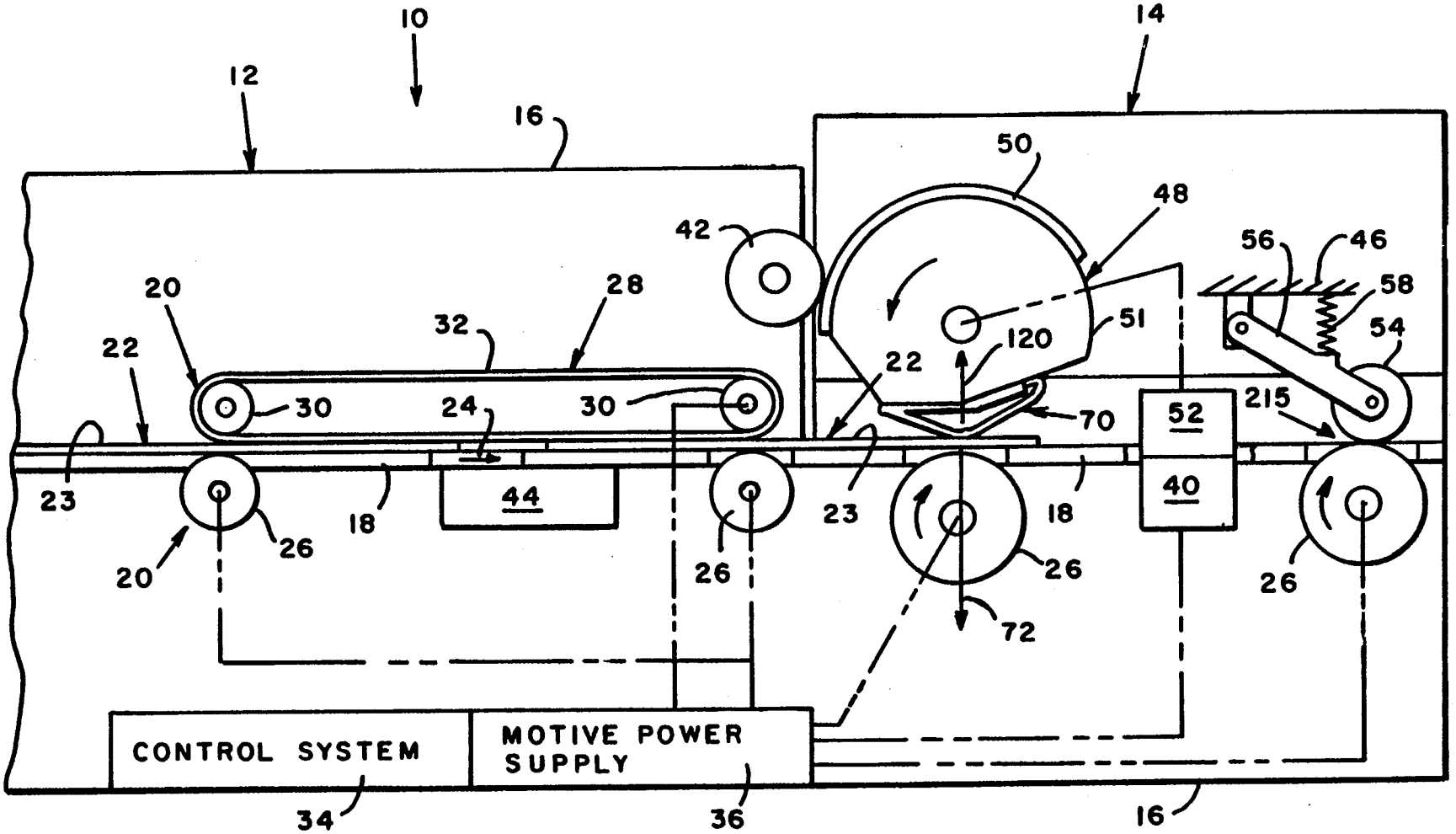
FIG. 1 is a mailing machine including a base and postage meter having a rotary postage printing drum equipped with an envelope deflecting device according to the invention.

As shown in FIG. 1, a mailing machine 10, of the type which may be modified in accordance with the invention, generally includes a mailing machine base 12 and a postage meter 14 removably mounted on the base 12.

The base 12 (FIG. 1) includes a conventional housing 16 and a suitable deck 18 which extends beneath the postage meter 14. In addition, the base 12 includes conventional structure 20 for feeding sealed and unsealed envelopes 22, having respective upper surfaces 23, in a downstream path of travel 24 on the deck 18. The envelope feeding structure 20 includes a plurality of envelope feed rollers 26 which are conventionally rotatably connected to the housing 16 beneath the deck 18 so as to protrude upwardly therethrough and extend into the path of travel 24. Moreover, the envelope feeding structure 20 includes a conventional belt assembly 28, including a pair of rollers 30 which are spaced apart from one another and suitably rotatably connected to the housing 16 above the deck 18, and including an endless belt 32 which is looped about the rollers 30 for disposition thereof in overhanging relationship with the deck 18 so as to extend into the path of travel 24. Further, the mailing machine base 12 including a conventional control system 34, and includes a suitable source of supply 36 of motive power. The motive power supply 36 is conventionally connected between rollers 26, 30 and the control system 34, for driving the rollers 26, 30, and thus the belt 32, under the control of the control system 34. Still further, the base 12 includes a conventional postage meter drive train 40 which is suitably connected to the motive power supply 36 for operation of the drive train 40 under the control of the control system 34. In addition, the base 12 includes a conventional inking roller 42, which is suitably connected to the housing 16 for rotation and to protrude from the housing towards the postage meter 14 to provide printing ink therefor. And, the base 12 includes conventional envelope flap moistening structure 44, for moistening the flaps of unsealed envelopes 22 preparatory to sealing the same.

The postage meter 14 (FIG. 1) includes conventional framework 46, and includes a rotary postage printing drum 48, having a postage printing die 50 extending from the outer periphery 51 thereof. Further, the postage meter 14 includes a conventional drum drive train 52 which is suitably connected to the postage printing drum 48 for rotation thereof. The drum drive train 52 is also conventionally connected to the postage meter drive train 40 when the meter 14 is mounted on the base 50. As thus constructed and arranged, the drum 50 is interconnected to the base 12 for driving the drum 50 under the control of the control system 34. Moreover, the postage meter 14 includes an outfeed roller 54, which is conventionally rotatably attached to an arm 56 pivoted to the postage meter framework 46. And, the meter 14 includes a spring 58 disposed between the framework 46 and outfeed roller 54 for urging the roller 54 downwardly towards the deck 18 against the upwardly directed force exerted by an envelope 22 passing therebeneath.

A more detailed description of the foregoing mailing machine 10 may be found in the aforesaid U.S. Patents, wherein the envelope feeding roller 30 which is located beneath the postage printing drum 50 is referred to and known in the art as an impression roller 30 and the envelope feeding roller 30 which is located beneath the outfeed roller 54 is referred to and known in the art as an ejection roller 30. And wherein the control system 34 is conventionally constructed and arranged for controlling the motive power supply 36, in response to operator input, to independently drive the sheet feeding structure 20 and postage printing drum 50, for operating the mailing machine 10 in various modes of operation wherein envelopes are fed through the machine 10 with or without driving the drum 50 for rotation thereof into engagement with the envelopes for printing and feeding purposes.

The postage meter 14 (FIG. 1) preferably includes envelope deflecting structure 70 which is fixedly connected to the postage printing drum 50 for disposition thereof in overhanging relationship with the deck 18 when the drum 50 is stationary, to apply a normal, resultant, force 72 to envelopes 22 fed downstream in the path of travel 24 beneath the drum 48. The deflecting structure 70 is an elongate device which longitudinally extends across the deck 18 and has a generally inverted V-shape in transverse cross-section. Thus the deflecting structure 70 includes a lower marginal peak portion 74, which extends transverse to the path of travel 24 of envelopes 22 fed downstream on the deck 18, for engaging the upper surfaces 23 of the envelopes 22.

Figure 2:
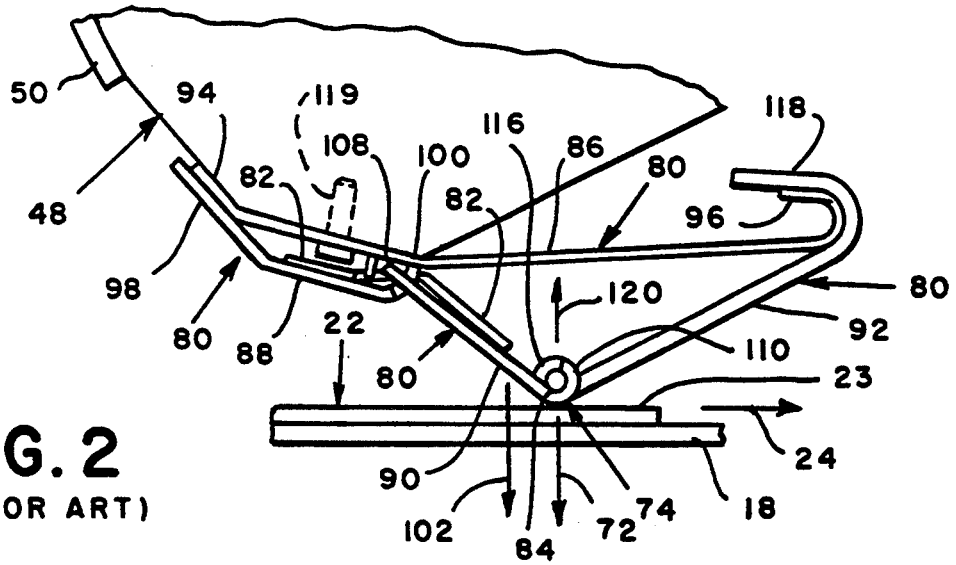
FIG. 2 (PRIOR ART)
FIG. 2 is schematic view of a postage printing drum having attached thereto a prior art envelope deflecting device including a plurality of stainless steel parts.

As shown in FIG. 2, the prior art deflecting structure 70 is a complexly constructed, high cost, device which is fabricated from a multiplicity of stainless steel stampings 80, a spring 82 and a hinge pin 84. The stampings 80 include an upper wall portion 86, a lower, spring retaining, wall portion 88, a lower, leading, wall portion 90 which is downwardly inclined to the peak edge portion 74 and a lower, trailing, wall portion 92 which is upwardly inclined from the peak edge portion 74. The upper wall portion 86 includes upstream and downstream, longitudinally-extending, marginal edges, 94 and 96. The downstream edge 96 is hook-shaped in transverse cross-section. The spring retaining wall portion 88 includes upstream and downstream, longitudinally extending, marginal edges, 98 and 100. The upstream edge 98 is spot welded at intervals therealong to the upper wall portion's upstream edge 94. The spring retaining wall portion 88 extends downstream from the upstream edge 98 and beneath the upper wall portion 86 to the downstream edge 100, which is conventionally configured for being hingedly connected to the leading wall portion 90. The spring 82 is preferably a made of a contoured length of wire extending downstream from between the upper and retainer wall portions, 86 and 88, and into engagement with the leading wall portion 90 so as to exert a downwardly directed force 102 against the leading wall portion 90. The leading wall portion 90 includes upstream and downstream, longitudinally-extending, marginal edges 108 and 110. The upstream edge 108 is conventionally complementarily configured relative to the retainer Wall portion's downstream marginal edge 100 for being hingedly connected thereto. And, the downstream edge 110 is conventionally configured for being hingedly connected to the trailing wall portion 92 by means of the hinge pin 84. As thus constructed and arranged, the spring force 102 causes the leading wall portion 90 to be inclined downwardly from the upper wall portion 86 to the trailing wall portion 92. The trailing wall portion 92 includes upstream and downstream, longitudinally-extending, marginal edges 116 and 118. The upstream edge 116 is conventionally complementarily configured relative to the leading wall portion's downstream marginal edge 110 for being hingedly connected thereto by means of the hinge pin 84. The downstream edge 118 is hook-shaped in transverse cross-section, in a manner such that it is conventionally complementarily configured relative to the upper wall portion's hook-shaped downstream edge 96 for slidably receiving and nesting the downstream edge 96 therewithin. The trailing wall portion 92 is thus inclined upwardly from the leading wall portion 90 to the upper wall portion 86. Further, the leading and trailing wall portion's complementarily configured edges, 110 and 116, are hingedly connected to one another by means of the hinge pin 84, to define the envelope deflecting structure's lower peak portion 74.

The prior art envelope deflecting structure 70 (FIG. 2) is conventionally fixedly connected to the postage printing drum 48 as by means of a plurality of suitable fasteners 119, located at spaced intervals longitudinally of the length of the structure 70, which pass through the upper wall portion 86. When the leading and trailing wall portions, 90 and 92, are urged upwardly in response to a force 120, opposite to the force 72, which is exerted against the peak edge portion 74 by envelopes 22 passing therebeneath, the trailing wall portion's hook-shaped marginal edge 118, slidably moves in engagement with upper wall portions hook-shaped marginal edge 96 and against the force 72, due to the spring 82, which is exerted against the envelope 22 by the deflecting structure 70 as the leading wall portion 90 is pivoted upwardly against the force 102 exerted thereagainst by the spring 82.

Figure 3:
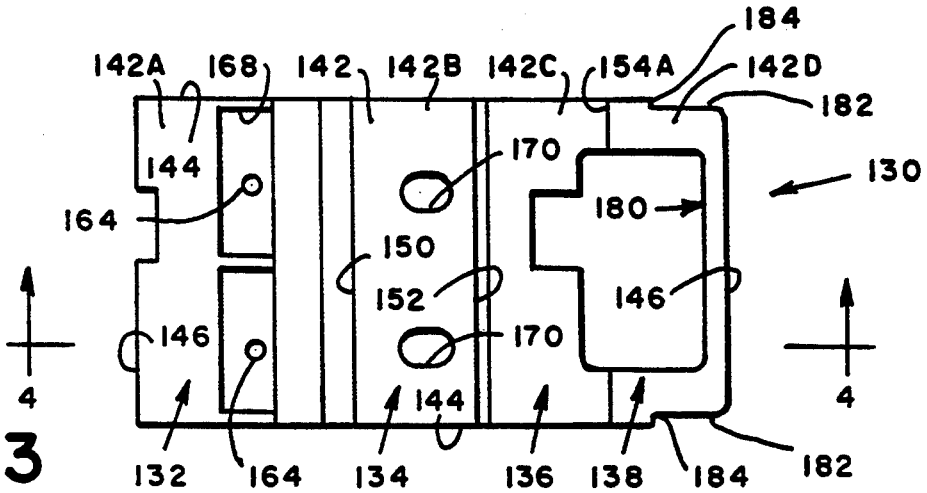
FIG. 3 is a top plan view of a molded plastic member for forming an envelope deflecting device according to the invention.
Figure 4:
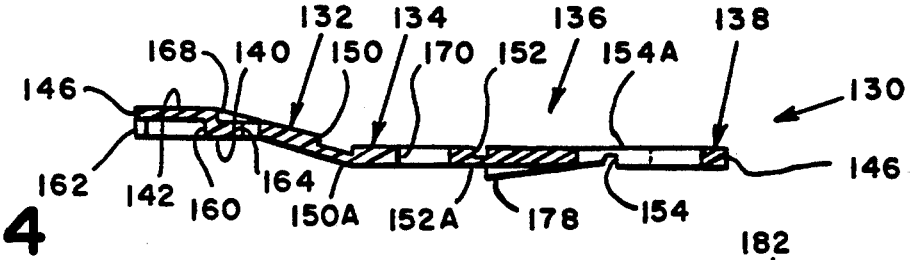
FIG. 4 is a sectional view, taken substantially along the line 4—4 of FIG. 3 or 5, showing the molded plastic member of FIG. 3.
Figure 5:
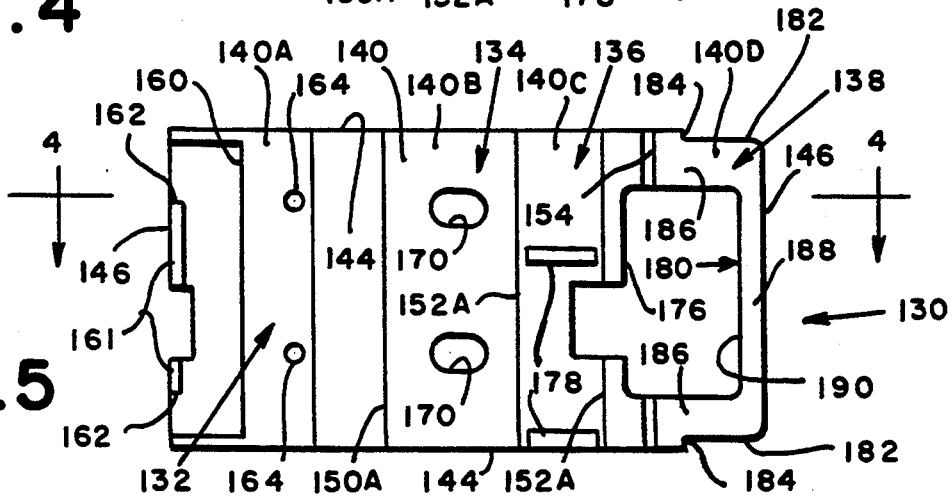
FIG. 5 is a bottom plan view of the molded plastic member of FIG. 3.
Figure 6:
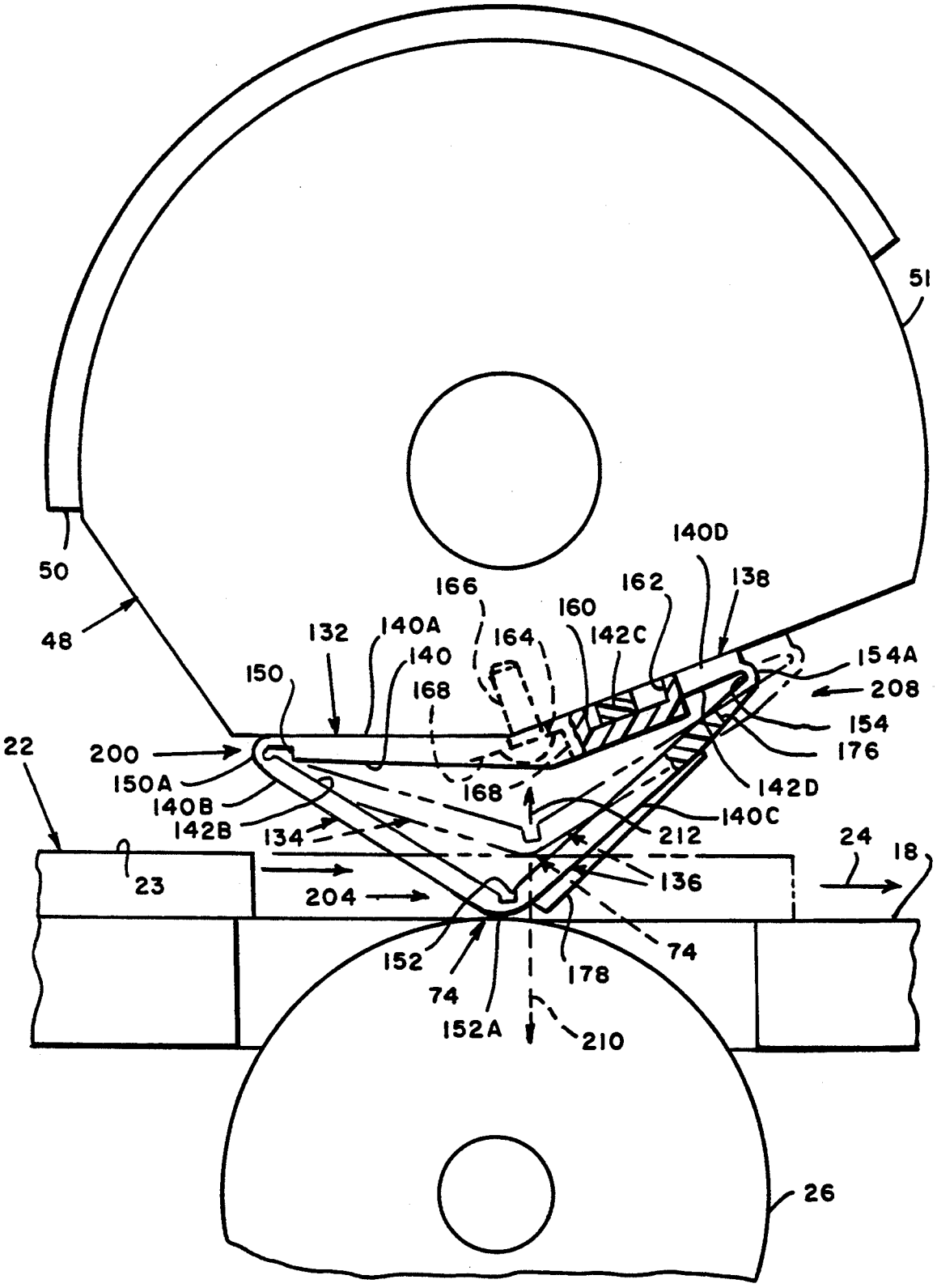
FIG. 6 is a side elevation of the member of FIG. 3 after having been folded and attached to a rotary postage printing drum according to the invention to form an envelope deflecting device according to the invention, and showing the manner in which the deflecting device is configured relative to the drum for cooperation therewith in the course of operation of the mailing machine.

According to the invention, the envelope deflecting structure 70 (FIG. 6) is a simply constructed, low cost, device which is preferably molded as a single, elongate substantially rectangulary-shaped resilient, plastic member 130 (FIGS. 3–5), from a thermoplastic, plastic material, such as, and preferably, polypropelene plastic, and then folded to form the deflecting structure 70 (FIG. 6). The member 130 includes a first, upper, wall portion 132, a second, leading, wall portion 134, a third, trailing, wall portion 136 and a fourth, slidable, wall portion 138. As shown in FIGS. 3–5, the member 130 has opposed side surfaces 140 and 142, oppositely located, longitudinally-extending, side edges 144, and oppositely located, transversely-extending end edges 146. The wall portions, 132, 134, 136 and 138 are each substantially rectangularly-shaped portions of the member 130, which are defined therein by means of a plurality first, second and third channels, 150, 152 and 154, respectively, which are formed in one of the member's side surfaces 140 or 142, and by means of oppositely located first, second and third crease lines, 150A, 152A and 154A, respectively, which are formed in the member's opposite side surface, 142 or 140. The upper wall portion 132 is defined by the channel 150 and opposite crease line 150A and extends therefrom longitudinally of the length of the member 130 to the nearest of the end edges 146. The leading wall portion 134 is defined by and lies between the channel and opposite crease line 150 and 150A, and the channel and opposite crease line 152 and 152A. The trailing wall portion 136 is defined by and lies between the channel and opposite crease line 152 and 152A, and the channel and opposite crease line 154 and 154A. And, the slidable wall portion 138 is defined by the channel 154 and opposite crease line 154A and extends therefrom longitudinally of the length of the member 130 to the nearest of the end edges 146.

The member's upper wall portion 132 (FIG. 6) has an outer surface 140A (FIGS. 5 and 6) and an inner surface 142A (FIGS. 3 and 6). The outer surface 140A (FIG. 5) includes an elongate, substantially rectangularly-shaped cavity 160 formed therein alongside the upper wall portion's associated end edge 146. And, the upper wall portion 132 includes a marginal lip element 161 which has formed therein, at spaced intervals therealong, a pair of slots 162. In addition, the upper wall portion 132 (FIGS. 3 and 5) includes a pair of apertures 164 formed therein for receiving therethrough a pair of conventional fasteners 166 (FIG. 6), which are preferably conventional machine screws. And, the upper wall portion's inner surface 142 (FIG. 3) includes a pair of cavities 168 formed therein in surrounding relationship with the fastener apertures 164 for receiving therewithin the fasteners 166 (FIG. 6) and, in particular, the machine screw heads.

The member's leading wall portion 134 (FIG. 6) has an outer surface 140B (FIGS. 5 and 6) and an inner surface 142B (FIGS. 3 and 6). And the leading wall portion 134 (FIG. 3, 5 and 6) includes a pair of conventional clearance apertures 170 which are formed therein at spaced intervals corresponding to the spacing of the upper wall fastener apertures 164 to accommodate passing a screw driver through the clearance apertures 170 to engage the machine screws 166 for fixedly attaching the envelope deflecting device 70 to the postage printing drum 48.

The member's trailing wall portion 136 (FIG. 6) has an outer surface 140C (FIGS. 5 and 6) and in inner surface 142C (FIGS. 3 and 6) The outer surface 140C (FIGS. 5 and 6) includes a cavity 176 formed therein for weakening the channel and crease line 154 and 154A (FIGS. 3 and 5) against folding therealong. And, the outer surface 140C (FIGS. 4 and 5) includes a pair of foot members 178 protruding therefrom at spaced intervals near the lower peak edge 74 (FIG. 6) of the envelope deflection device 70.

The member's slidable wall portion 138 (FIG. 6) has an outer surface 140D (FIGS. 5 and 6) and an inner surface 142D (FIGS. 3 and 6). The slidable wall portion 138 (FIGS. 3 and 5) includes a substantially rectangularly-shaped cavity 180 formed therein, and the opposite side edges 144 of the member 130 are notched to form a pair of opposed slots 182 formed inwardly of the member's side edges 144 and of the associated end edge 146. Moreover, the slidable wall portion 138 includes a pair of oppositely spaced stop edges 184 (FIG. 5) formed by the slots 182. As thus constructed and arranged, the slidable wall portion 138 has a substantially C-shaped configuration and includes a pair of substantially rectangularly-shaped, oppositely disposed, arm elements 186, which extend from the channel 154. In addition, the slidable wall portion 138 and includes a substantially rectangularly-shaped strut element 188, including the wall portion's associated end edge 146, which extends between the arm elements 186. Preferably, the strut element 188 is dimensioned relative to the upper wall portion's cavity 160 to be loosely received therewithin. And, the arm elements 186 (FIGS. 5 and 6) are preferably dimensioned relative to the upper wall portion's lip apertures 162 for slidable movement therewithin when the strut element 188 is disposed within the cavity 160. When disposed within the cavity 160, the strut element's inner edge 190 cooperates with the upper wall portions' marginal lip element 161 to act as a stop for preventing slidable removal of the strut element 188 from the cavity 160.

As shown in FIGS. 3–5, the member 130 is designed for folding along each of the channel and crease lines, 150 and 150A, 152 and 152A, and 154 and 154A, to form the envelope deflecting device 70 shown in FIGS. 1 and 6. As shown in FIG. 6, the member's slidable portion 138 is disposed within the upper wall portions cavity 160. And the upper wall portion's outer surface 140A is fixedly attached to the postage printing drum 48, by means of the fasteners 166, in a manner such that the slidable wall portion 138 is captured between the drum 48 and upper wall portion 132 and is slidably movable therebetween. Thus the drum 48 and the member's upper wall portion 132 cooperatively hold the member's slidable wall portion 138 within the upper wall portion's cavity 160 for slidable movement therein, upstream and downstream relative to the path of travel 24. In addition, the leading wall portion is inclined downwardly from the upper wall portion 134, commencing at the folded channel and crease line 150 and 150A and extending to the folded channel and crease line 152 and 152A. Further, the trailing wall portion 136 is inclined upwardly from the leading wall portion 134, commencing at the folded channel and crease line 152 and 152A, and extending to the folded channel and crease line 154 and 154A. Thus the leading and trailing wall portions 134 and 136 cooperatively define a lower marginal peak edge 74 of the envelope deflecting device 70.

As thus constructed and arranged, the envelope deflecting structure 70 (FIG. 6), includes a first, upstream, resilient, hinge, portion 200 formed by the folded channel and crease line, 150 and 150A, which are shared by the upper and leading wall portions, 132 and 134. In addition, the envelope deflecting structure 70 includes a second, lower peak edge, resilient, hinge, portion 204 formed by the folded channel and crease lines, 152 and 152A, which are shared by the leading and trailing wall portions, 134 and 136. And, the envelope deflecting structure 70 includes a third, downstream, resilient, hinge, portion 208 formed by the folded channel and crease lines, 154 and 154A, which are shared by the trailing and slidable wall portions, 154 and 154A. The upstream hinge portion 200, peak hinge portion 204 and downstream hinge portion 208, cooperatively exert a downwardly directed force 210 against the upper surfaces 23 of moving envelopes 22 passing beneath the stationary drum 48 in response to such envelopes 22 exerting an upwardly directed force 212 against the lower peak edge 74 of the envelope deflecting structure 70. The downwardly directed force 210 is primarily due to the energy stored in the upstream hinge portion 200 when the envelopes 22 urge the peak edge 74 upwardly. In this connection it is noted that some of the upwardly directed force 212, exerted by the envelope 22 against the envelope deflecting structure's peak edge 74, is dissipated by sliding movement of the slidable wall portion 138 outwardly, or downstream, of the upper wall portions cavity 160 as indicated by the dotted line presentation. In any event, the collective, downwardly directed, normal, force 210 exerted by the envelope deflecting structure 70 against the envelopes 22 passing therebeneath, when the drum 48 is stationary, is sufficient to hold the moving envelopes 22 in sliding relationship with the deck 18 (FIG. 1) for feeding the envelopes 22 into the nip 215 between the outfeed idler roller 54 and opposing, outfeed, ejection roller 26.

What is claimed is:

1. A mailing machine comprising:

(a) a base including a deck;

(b) a postage meter removably mounted on the base, the postage meter including a rotary postage printing drum overhanging the deck;

(c) the base including means for feeding an envelope in a downstream path of travel to the drum, the base including means for selectively driving the drum for printing postage on an envelope fed thereto;

(d) envelope deflecting means including an elongate substantially rectangularly-shaped member having a predetermined length, the member including a substantially horizontally-extending first portion of the length thereof fixedly attached to the drum, the member including a second portion of the length thereof inclined downwardly from the first portion, the member including a third portion of the length thereof inclined upwardly from the second portion, the member including a fourth portion of the length thereof extending substantially horizontally from the third portion and disposed between and in sliding engagement with the drum and the first portion, and the second and third portions cooperatively defining a lower marginal peak edge overhanging the deck and extending transversely of the path of travel for urging an envelope fed beneath the drum into sliding engagement with the deck.

2. The mailing machine according to claim 1, wherein the member includes first means for hingedly connecting the first and second portions.

3. The mailing machine according to claim 2 wherein the member includes upper and lower surfaces, and the member including an elongate channel formed in the member from the upper surface thereof, and wherein the member is bent along the channel for resiliently urging the lower marginal peak edge toward the deck.

4. The mailing machine according to claim 1, wherein the member is molded from a resilient plastic material, and wherein the lower marginal peak edge resiliently urges an envelope fed therebeneath into sliding engagement with the deck.

5. The mailing machine according to claim 1, wherein the first portion includes an upper surface, the first portion including a cavity formed therein from the upper surface thereof, and the fourth portion slidably disposed within the cavity.

6. The mailing machine according to claim 5, wherein the fourth portion is substantially C-shaped, the fourth portion including a pair of oppositely spaced arm elements and a strut element extending therebetween, the first portion includes a lip edge element having a pair of slots formed therein at spaced intervals therealong, the arm elements slidably disposed within the slots, and the strut element slidably disposed within the cavity.

7. The mailing machine according to claim 6, wherein the strut element includes an elongate inner edge cooperative with the lip edge element for stopping slidable removal of the fourth portion from the first portion and thus from between the first portion and the drum.

* * * * *